US009615159B2

(12) United States Patent
Wong et al.

(10) Patent No.: US 9,615,159 B2
(45) Date of Patent: Apr. 4, 2017

(54) METHOD AND DEVICE FOR SUPPLYING POWER FOR ACTIVE NOISE CANCELATION EARPHONE BY UTILIZATION OF POWER SOURCE OF ELECTRONIC EQUIPMENT

(71) Applicant: Anpac Semiconductor Limited, Hong Kong (CN)

(72) Inventors: Fun Tak Wong, Hong Kong (CN); Kai Hon Ho, Hong Kong (CN); Kenneth Kin Keung Lee, Hong Kong (CN)

(73) Assignee: Anpac Semiconductor Limited, Hong Kong (CN)

( * ) Notice: Subject to any disclaimer, the term of this patent is extended or adjusted under 35 U.S.C. 154(b) by 218 days.

(21) Appl. No.: 14/383,519

(22) PCT Filed: Jun. 17, 2013

(86) PCT No.: PCT/CN2013/077313

§ 371 (c)(1),
(2) Date: Sep. 5, 2014

(87) PCT Pub. No.: WO2014/180023

PCT Pub. Date: Nov. 13, 2014

(65) Prior Publication Data

US 2015/0237435 A1 Aug. 20, 2015

(30) Foreign Application Priority Data

May 8, 2013 (CN) ..... 2013 1 0167419
May 16, 2013 (CN) ..... 2013 1 0182104

(51) Int. Cl.

| | |
|---|---|
| ***H04R 1/10*** | (2006.01) |
| ***H04R 1/06*** | (2006.01) |
| ***H04R 1/08*** | (2006.01) |

(52) U.S. Cl.
CPC ..... *H04R 1/1025* (2013.01); *H04R 1/06* (2013.01); *H04R 1/08* (2013.01)

(58) Field of Classification Search
None
See application file for complete search history.

(56) References Cited

U.S. PATENT DOCUMENTS

2001/0053228 A1* 12/2001 Jones ..... G10K 11/1788 381/71.6
2006/0013408 A1 1/2006 Lee
(Continued)

FOREIGN PATENT DOCUMENTS

CN 1251491 A 4/2000
CN 1738488 A 2/2006
(Continued)

*Primary Examiner* — Paul Huber
(74) *Attorney, Agent, or Firm* — Aka Chan LLP

(57) ABSTRACT

A method and device for supplying power for an ANC (Active Noise Cancelation) earphone by utilization of a power source of an electronic equipment. According to the power supplying method, power is supplied to a noise canceling circuit of the ANC earphone and its related circuits by the power source of the electronic equipment through a microphone contact, a left channel audio contact, or a right channel audio contact of an earphone jack of the electrical equipment. The power supplying device includes the ANC earphone and the electronic equipment. This invention enables the ANC earphone to directly obtain power from the power source of the electronic equipment, so that the ANC earphone is simple in structure, convenient to carry, suitable for mass production, low in production cost, and high in compatibility.

12 Claims, 9 Drawing Sheets

(56) References Cited

U.S. PATENT DOCUMENTS

| | | | | |
|---|---|---|---|---|
| 2010/0260362 | A1* | 10/2010 | Sander | H04R 1/1041 381/309 |
| 2012/0148062 | A1 | 6/2012 | Scarlett et al. | |
| 2012/0308030 | A1 | 12/2012 | Yamkovoy et al. | |
| 2012/0321097 | A1* | 12/2012 | Braho | H04R 1/10 381/74 |
| 2014/0270229 | A1* | 9/2014 | Braho | H04R 1/1025 381/74 |

FOREIGN PATENT DOCUMENTS

| | | | |
|---|---|---|---|
| CN | 102291643 | A | 12/2011 |
| CN | 102333256 | A | 1/2012 |
| WO | 2012/167006 | A1 | 6/2012 |

* cited by examiner

METHOD AND DEVICE FOR SUPPLYING POWER FOR ACTIVE NOISE CANCELATION EARPHONE BY UTILIZATION OF POWER SOURCE OF ELECTRONIC EQUIPMENT

CROSS-REFERENCE TO RELATED APPLICATIONS

This patent application is a section 371 national phase filing of PCT patent application PCT/CN2013/077313, filed Jun. 17, 2013, which claims priority to a China patent application 201310182104.4, filed May 16, 2013, and a China patent application 201310167419.1, filed May 8, 2013.

FIELD OF INVENTION

This invention relates to the field of audio equipment, and more specifically, to a method and device for supplying power for an active noise cancelation (ANC) earphone by utilization of a power source of electronic equipment.

BACKGROUND OF THE INVENTION

With the emergence and popularity of various types of smart electronic equipment, earphones have become more important accessories for electronic equipment in people's daily lives. Noisy environments can interfere with the quality of the sound received through earphones. Some people who are especially affected are business people who frequently travel by air, people who commute on crowded subway trains and buses, as well as people who work inside air-conditioned rooms. Therefore, there is a rapidly growing demand for noise canceling earphones.

ANC (Active Noise Cancelation) earphones are a type of noise canceling earphones, and unlike standard earphones, include a noise canceling circuit for canceling noise in addition to an earphone plug and an audio playback unit. The noise canceling circuit typically requires power from a dedicated power source in order to sufficiently power it. The power source usually contains a battery, a voltage converter, and a regulator circuit. When compared to standard earphones (e.g., non-ANC earphones), these components increase the size, weight, and cost of ANC earphones. Further, the battery voltage of typical battery cells is generally not suitable for directly driving the noise canceling circuits. The noise canceling circuit further needs to comprise a DC-to-DC (direct current to direct current) voltage conversion circuit to regulate and stabilize the battery voltage to reach the suitable operating voltage range of the noise canceling circuit. The noise canceling circuit structurally complicates earphones by requiring earphones to have more components; the noise canceling circuit further complicates earphone mass production by increasing earphone sizes, weights, and production costs.

Among the prior art, there is a method of directly using an electronic equipment's power source to supply power to a noise canceling earphone. This method configures a power pin receptacle of an electronic equipment's earphone jack, configures a power pin of a noise canceling earphone's earphone plug, and supplies power from the power source of the electronic equipment through the coupling between the earphone jack's power pin receptacle and the earphone plug's power pin to a noise canceling circuit of the earphone. This method requires both the earphone plug and earphone jack to have a specific structural configuration, namely a 5-pole configuration. In order to achieve noise cancelation, the 5-pole earphone plug and the 5-pole earphone jack must be used together. This restricts the compatibility between noise canceling earphones and electronic equipment.

BRIEF SUMMARY OF THE INVENTION

The present invention provides a method and device for supplying power for an ANC earphone by utilization of a power source of an electronic equipment. This invention allows the ANC earphone to take power directly from the electronic equipment and does not require installing a dedicated power supply or a power conversion circuit into the ANC earphone. This invention gives the ANC earphone the advantages of having a lower cost of production and a simple structure that is easy to carry and mass produce. Compared to the 5-pole (or 5-terminal) configuration discussed above, this invention has the advantage that the noise canceling earphones and electronic equipment are highly compatible.

The present invention includes: a method for supplying power for an ANC earphone by utilization of a power source of electronic equipment. In a listening mode, a power source of the electronic equipment supplies power through a microphone contact of an earphone jack of the electronic equipment to a microphone contact of an earphone plug of the ANC earphone. In this mode, the power source of the electronic equipment is used to supply power to a noise canceling circuit of the ANC earphone.

In a dialogue mode of the method of the invention discussed above for supplying power for an ANC earphone by utilization of a power source of electronic equipment, the power source of the electronic equipment supplies power through a left channel audio contact of the earphone jack of the electronic equipment to a left channel audio contact of the earphone plug of the ANC earphone or through a right channel audio contact of the earphone jack of the electronic equipment to a right channel audio contact of the earphone plug of the ANC earphone. In this mode, the power source of the electronic equipment is used to supply power to a noise canceling circuit of the ANC earphone.

In a specific embodiment of the dialogue mode of the method of the invention discussed above for supplying power for an ANC earphone by utilization of a power source of electronic equipment, the power source of the electronic equipment supplies power through the microphone contact of the earphone jack of the electronic equipment to the microphone contact of the earphone plug of the ANC earphone. In this mode, the power source of the electronic equipment is used to supply power to a noise canceling circuit of the ANC earphone; and hands-free microphone signals sent out by the ANC earphone are received by the electronic equipment through the left channel audio contact or the right channel audio contact of the earphone jack of the electronic equipment.

In the method of the invention discussed above for supplying power for an ANC earphone by utilization of a power source of electronic equipment, when an earphone plug is inserted into the earphone jack of the electronic equipment, the electronic equipment detects whether the earphone is in ANC mode; when the earphone is in ANC mode, it uses the power source of the electronic equipment to supply power to the noise canceling circuit of ANC earphone; when the earphone is in non-ANC mode, it operates as a standard earphone to connect and interact with the electronic equipment and does not require the electronic equipment to supply power.

In the method of the invention discussed above for supplying power for an ANC earphone by utilization of a power source of electronic equipment, a method of the electronic equipment to detect whether the earphone is in ANC mode comprises: detecting the electrical characteristics (e.g., resistance, capacitance, inductance, or signal) of the microphone contact, left channel audio contact, or right channel audio contact of the earphone plug; if the electrical characteristics detected based on this electrical test match predetermined electrical parameters for ANC earphones, the earphone is in the ANC mode; if the electrical characteristics detected based on this electrical test match predetermined electrical parameters for standard earphones, the earphone is in the non-ANC mode.

In the method of the invention discussed above for supplying power for an ANC earphone by utilization of a power source of electronic equipment, a method of the electronic equipment to detect whether the earphone is in ANC mode further comprises: the electronic equipment sends an inquiry signal to the ANC earphone and the ANC earphone returns its mode (ANC mode or non-ANC mode) as a signal to the electronic equipment. This detecting of the earphone is done by signal handshaking exchange.

In the method of the invention discussed above for supplying power for an ANC earphone by utilization of a power source of electronic equipment, when the electronic equipment switches between listening mode and dialogue mode, the electronic equipment sends a signal to remind the ANC earphone. The ANC earphone then returns a signal to the electronic equipment and switches to the same mode as the electronic equipment.

In the method of the invention discussed above for supplying power for an ANC earphone by utilization of a power source of electronic equipment, a method of supplying power in listening mode comprises: a switch module of the electronic equipment disconnects a microphone terminal of an audio module of the electronic equipment from the microphone contact of the earphone jack, then connects the power source of the electronic equipment to the microphone contact of the earphone jack; a switch module of the ANC earphone disconnects the microphone contact of the earphone plug from a hands-free microphone circuit, then connects the microphone contact, the left channel audio contact, and the right channel audio contact in turn to a power supply terminal, a left channel audio terminal, and a right channel audio terminal of the noise canceling circuit.

In the method of the invention discussed above for supplying power for an ANC earphone by utilization of a power source of electronic equipment, a method for supplying power in dialogue mode comprises:

(1) The switch module of the electronic equipment disconnects the power source of the electronic equipment from the microphone contact of the earphone jack, disconnects a left channel audio terminal of the audio module from the left channel audio contact of the earphone jack, connects the power source of the electronic equipment to the left channel audio contact of the earphone jack, connects a right channel audio terminal of the audio module to the right channel audio contact of the earphone jack, and connects the microphone terminal of the audio module to the microphone contact of the earphone jack; the switch module of the ANC earphone connects the left channel audio contact of the earphone plug to the power supply terminal of the noise canceling circuit, connects the right channel audio contact of the earphone plug to the left and right channel terminals of the noise canceling circuit, and connects the microphone contact of the earphone plug to the hands-free microphone circuit of the earphone;

(2) The switch module of the electronic equipment disconnects the power source of the electronic equipment from the microphone contact of the earphone jack, disconnects a right channel audio terminal of the audio module from the right channel audio contact of the earphone jack, connects the power source of the electronic equipment to the right channel audio contact of the earphone jack, connects a left channel audio terminal of the audio module to the left channel audio contact of the earphone jack, and connects the microphone terminal of the audio module to the microphone contact of the earphone jack; the switch module of the ANC earphone connects the right channel audio contact of the earphone plug to the power supply terminal of the noise canceling circuit, connects the left channel audio contact of the earphone plug to the left and right channel terminals of the noise canceling circuit, and connects the microphone contact of the earphone plug to the hands-free microphone circuit of the earphone.

In the method of the invention discussed above for supplying power for an ANC earphone by utilization of a power source of electronic equipment, another embodiment of the dialogue mode comprises:

(1) The switch module of the electronic equipment connects the power source of the electronic equipment to the microphone contact of the earphone jack, connects the microphone terminal of the audio module to the left channel audio contact on the earphone jack; the switch module of the ANC earphone connects the microphone contact of the earphone plug to the power supply terminal of the noise canceling circuit, connects the left channel audio contact on the earphone plug to the hands-free microphone circuit of the earphone, and connects the right channel audio contact on the earphone plug to the left and right channel audio terminals of the noise canceling circuit; one of the left channel audio terminal or the right channel audio terminal of the audio module is selected and connected to the right channel audio contact of the earphone jack, and the selected channel audio terminal is used to transmit the left audio signal or the right audio signal sent out by the audio module.

(2) The switch module of the electronic equipment connects the power source of the electronic equipment to the microphone contact of the earphone jack, connects the microphone terminal of the audio module to the right channel audio contact of the earphone jack; the switch module of the ANC earphone connects the microphone contact of the earphone plug to the power supply terminal of the noise canceling circuit, connects the right channel audio contact on the earphone plug to the hands-free microphone circuit of the earphone, and connects the left channel audio contact on the earphone plug to the left and right channel audio terminals of the noise canceling circuit; one of the left channel audio terminal or the right channel audio terminal of the audio module is selected and connected to the left channel audio contact of the earphone jack, and the selected channel audio terminal is used to transmit the left audio signal or the right audio signal sent out by the audio module.

In the method of the invention discussed above for supplying power for an ANC earphone by utilization of a power source of electronic equipment, when the ANC earphone switches between the listening and dialogue modes, the ANC earphone has no external power supply for a moment. An electrical energy storage module of the ANC earphone obtains and stores power from the electronic equipment until the ANC earphone needs to supply power to the noise canceling circuit, a detection and control module, and the switch module when there is no external power supply.

In the method of the invention discussed above for supplying power for an ANC earphone by utilization of a power source of electronic equipment, the electronic equipment has speech capabilities and may be, but is not limited to, a cell phone, personal computer, laptop, or tablet.

A device used to achieve the method of the invention discussed above for supplying power for an ANC earphone by utilization of a power source of electronic equipment, comprising an ANC earphone and an electronic equipment, wherein the components of the ANC earphone with identical names as the components of the electronic equipment are referred to by an "A" identifier and the components of the electronic equipment with identical names as the components of the ANC earphone are referred to by a "B" identifier; the ANC earphone comprises an earphone plug comprising a ground contact A, a microphone contact A, a left channel audio contact A, and a right channel audio contact A; a switch module A, wherein the switch module A is connected to the earphone plug; a noise canceling circuit comprising a power supply terminal, a left channel audio terminal A, and a right channel audio terminal A, wherein the switch module A is connected to the noise canceling circuit; a detection and control module A, wherein the detection and control module A is connected to the earphone plug; an audio playback unit; and a hands-free microphone circuit, wherein the hands-free microphone circuit is connected to the switch module A; the electronic equipment comprises a power source; a switch module B, wherein the switch module B is connected to the power source; an earphone jack comprising a ground contact B, a microphone contact B, a left channel audio contact B, and a right channel audio contact B, wherein the switch module B is connected to the earphone jack; an audio module comprising a microphone terminal, a left channel audio terminal B, and a right channel audio terminal B, wherein the audio module is connected to the switch module B; and a detection and control module B, wherein the detection and control module B is connected to the earphone jack.

In the device of the invention discussed above for supplying power for an ANC earphone by utilization of a power source of electronic equipment, when the electronic equipment is in a listening mode, the power source is connected through the switch module B to the microphone contact B, the left channel audio terminal B is connected through the switch module B to the left channel audio contact B, and the right channel audio terminal B is connected through the switch module B to the right channel audio contact B. When the ANC earphone is in a listening mode, the microphone contact A is connected through the switch module A to the power supply terminal, the left channel audio contact A is connected through the switch module A to the left channel audio terminal A, and the right channel audio contact A is connected through the switch module A to the right channel audio terminal A.

In the device of the invention discussed above for supplying power for an ANC earphone by utilization of a power source of electronic equipment, when the electronic equipment is in a dialogue mode, the power source is connected through the switch module B to the left channel audio contact B, the microphone terminal is connected through the switch module B to the microphone contact B, and the right channel audio terminal B is connected through the switch module B to the right channel audio contact B. When the ANC earphone is in a dialogue mode, the microphone contact A is connected through the switch module A to the hands-free microphone circuit, the left channel audio contact A is connected through the switch module A to the power supply terminal, and the right channel audio contact A is connected through the switch module A to the left channel audio terminal A and the right channel audio terminal A.

In the device of the invention discussed above for supplying power for an ANC earphone by utilization of a power source of electronic equipment, when the electronic equipment is in a specific embodiment of the dialogue mode, the power source is connected through the switch module B to the right channel audio contact B, the microphone terminal is connected through the switch module B to the microphone contact B, and the left channel audio terminal B is connected through the switch module B to the left channel audio contact B. When the ANC earphone is in a specific embodiment of the dialogue mode, the microphone contact A is connected through the switch module A to the hands-free microphone circuit, the left channel audio contact A is connected through the switch module A to the left channel audio terminal A and the right channel audio terminal A, and the right channel audio contact A is connected through the switch module A to the power supply terminal.

In the device of the invention discussed above for supplying power for an ANC earphone by utilization of a power source of electronic equipment, when the electronic equipment is in a specific embodiment of the dialogue mode, the power source is connected through the switch module B to the microphone contact B, and the microphone terminal is connected through the switch module B to the left channel audio contact B. When the ANC earphone is in a specific embodiment of the dialogue mode, the microphone contact A is connected through the switch module A to the power supply terminal, the left channel audio contact A is connected through the switch module A to the hands-free microphone circuit, and the right channel audio contact A is connected through the switch module A to the left channel audio terminal A and the right channel audio terminal A. Either the left channel audio terminal B of the audio module or right channel audio terminal B of the audio module is selected and connected to the right channel audio contact B of the earphone jack; the selected audio terminal is used to transmit the left or right audio signal sent from the audio module.

In the device of the invention discussed above for supplying power for an ANC earphone by utilization of a power source of electronic equipment, when the electronic equipment is in a specific embodiment of the dialogue mode, the power source is connected through the switch module B to the microphone contact B, and the microphone terminal is connected through the switch module B to the right channel audio contact B. When the ANC earphone is in a specific embodiment of the dialogue mode, the microphone contact A is connected through the switch module A to the power supply terminal, the right channel audio contact A is connected through the switch module A to the hands-free microphone circuit, and the left channel audio contact A is connected through the switch module A to the left channel audio terminal A and the right channel audio terminal A. Either the left channel audio terminal B of the audio module or right channel audio terminal B of the audio module is selected and connected to the left channel audio contact B of the earphone jack; the selected audio terminal is used to transmit the left or right audio signal sent from the audio module.

In the device of the invention discussed above for supplying power for an ANC earphone by utilization of a power source of electronic equipment, when the electronic equipment is in a normal mode (non-ANC mode), the microphone terminal is connected through the switch module B to the microphone contact B, the left channel audio terminal B is connected through the switch module B to the left channel audio contact B, and the right channel audio terminal B is connected through the switch module B to the right channel audio contact B. When the ANC earphone is in a normal mode (non-ANC mode), the microphone contact A is connected through the switch module A to the hands-free microphone circuit, and the left channel audio contact A and the right channel audio contact A are connected through the switch module A to the audio playback unit.

In the device of the invention discussed above for supplying power for an ANC earphone by utilization of a power source of electronic equipment, the detection and control module A is connected to the microphone contact A, left channel audio contact A, or right channel audio contact A.

In the device of the invention discussed above for supplying power for an ANC earphone by utilization of a power source of electronic equipment, the detection and control module B is connected to the microphone contact B, left channel audio contact B, or right channel audio contact B.

In the device of the invention discussed above for supplying power for an ANC earphone by utilization of a power source of electronic equipment, the ANC earphone further comprises an electrical energy storage module. The electrical energy storage module is connected to the power supply terminal, the detection and control module A, and the switch module A.

In the device of the invention discussed above for supplying power for an ANC earphone by utilization of a power source of electronic equipment, the noise canceling circuit, the detection and control module A, and the switch module A are integrated on a single chip.

In the device of the invention discussed above for supplying power for an ANC earphone by utilization of a power source of electronic equipment, the noise canceling circuit, the detection and control module A, the switch module A, and the electrical energy storage module are integrated on a single chip.

In the device of the invention discussed above for supplying power for an ANC earphone by utilization of a power source of electronic equipment, the detection and control module B, and the switch module B are integrated on a single chip.

In the device of the invention discussed above for supplying power for an ANC earphone by utilization of a power source of electronic equipment, the earphone plug comprises a plug body and a plug base which is connected to the plug body. At least one of the noise canceling circuit, the detection and control module A, the switch module A, or the electrical energy storage module is installed in the plug base.

In the device of the invention discussed above for supplying power for an ANC earphone by utilization of a power source of electronic equipment, at least one of the noise canceling circuit, the detection and control module A, the switch module A, or the electrical energy storage module is installed in the audio playback unit.

In the device of the invention discussed above for supplying power for an ANC earphone by utilization of a power source of electronic equipment, the ANC earphone further comprises a control unit which is connected between the earphone plug and the audio playback unit. The control unit controls the on or off status, audio playback volume, and quality of the audio playback unit.

In the device of the invention discussed above for supplying power for an ANC earphone by utilization of a power source of electronic equipment, at least one of the noise canceling circuit, the detection and control module A, the switch module A, or the electrical energy storage module is installed in the control unit.

In the device of the invention discussed above for supplying power for an ANC earphone by utilization of a power source of electronic equipment, at least one of the noise canceling circuit, the detection and control module A, the switch module A, or the electrical energy storage module is connected between the earphone plug and the control unit, or between the control unit and the audio playback unit.

In the device of the invention discussed above for supplying power for an ANC earphone by utilization of a power source of electronic equipment, the ANC earphone further comprises a manual switch or an electric switch to turn on or off the ANC mode of the ANC earphone. The manual switch or the electric switch is installed in the control unit.

In the device of the invention discussed above for supplying power for an ANC earphone by utilization of a power source of electronic equipment, if a manual select method is used to replace an automatic detection method, the detection and control module A and the switch module A can be simplified into manual hardware switches which are used to turn on or off the listening and dialogue modes of the ANC earphone.

In the device of the invention discussed above for supplying power for an ANC earphone by utilization of a power source of electronic equipment, the electronic equipment further comprises a control device which is used to turn on or off of the power source, and to control the detection and control module B and the switch module B.

In the device of the invention discussed above for supplying power for an ANC earphone by utilization of a power source of electronic equipment, the control device is a hardware, software, or firmware module which is used to set and adjust the operating parameters of the ANC earphone.

In the device of the invention discussed above for supplying power for an ANC earphone by utilization of a power source of electronic equipment, if the manual select method is used to replace automatic detection method, the detection and control module B and the switch module B can be simplified to manual hardware switches or man machine interface which are used to turn on or off the listening, dialogue, and ANC modes of the electronic equipment.

Compared to existing technology, this invention connects the left channel audio contact, right channel audio contact, or microphone contact of the earphone plug to the power source of the electronic equipment, which enables the ANC earphone to take power directly from the electronic equipment. This invention removes the battery, DC-to-DC voltage conversion circuit, and regulator circuit from the control unit of the ANC earphone, thus simplifying the structure of the control unit. The removal of these components gives the ANC earphone the advantages of having a lower cost of production and a simple structure that is easy to carry and mass produce.

In dialogue mode, this invention uses the left or right channel audio contact of the earphone jack of the electronic equipment to supply power to the ANC earphone, rather than the microphone contact, for the following reasons:

In mobile phones, for example, a bias voltage provided by microphone circuit of the mobile phone is around 3 volts, there is an approximately 2 kiloohm resistor between the bias voltage and a microphone contact in earphone jack of the mobile phone. If the microphone contact is used for providing power to an earphone and receiving microphone signal from the earphone at the same time, the following problem will happen.

Assuming the current consumption of the earphone circuit is 0-0.2 milliamperes, the voltage drop across 2 kiloohm resistor is 0-0.4 volts. This voltage drop of 0.4 volts is 13 percent of the 3 volt bias voltage of microphone circuit of the mobile phone. If this voltage drop is stable, it may not affect the microphone signal. However, this voltage drop will change with the current consumption of the earphone circuit. The current consumption of the earphone circuit is not stable and its change will produce an AC (alternating current) voltage signal (or noise) at the microphone contact. This noise will disturb the microphone signal sent from the earphone to the mobile phone. If the earphone circuit draws current greater than 0.2 milliamperes, it will cause another problem: the power source voltage received by the earphone after the 2 kiloohm resistor is very low and not suitable to drive the earphone circuit.

Therefore, in dialogue mode, the microphone contact of a mobile phone is not suitable for supplying power to the ANC earphone, i.e., the microphone contact cannot be used to send the microphone signal and supply power at the same time; likewise, in dialogue mode, the microphone contact of other electronic equipment is also not suitable for supplying power to the ANC earphone.

Given the microphone contact cannot be used to send the microphone signal and supply power at the same time, this invention further introduces another power supply method in dialogue mode. This power supply method in dialogue mode continues to use the route in listening mode to supply power through the microphone contact, selects the left or right audio channel to transmit the hands-free microphone signal, and the audio signal from the audio module is transmitted through the remaining audio channel to the left and right channel audio terminals of the noise canceling circuit. Because the power supply routes of the listening and dialogue modes are the same, the ANC earphone does not suspend power during mode switching and the electrical energy storage module is not required. This invention simplifies the hardware architecture and manufacturing process of ANC earphones and reduces their production cost.

Because the present invention does not change the traditional structure of 4-pole earphone jacks and plugs, the invention has the following benefits of compatibility from improving the circuits of the electronic equipment and earphone: 1. When an ANC earphone described by the present invention is connected to an electronic equipment described by the present invention, the ANC earphone gets power from the electronic equipment and realizes ANC function; 2. When an ANC earphone described by the present invention is connected to a typical electronic equipment (not the present invention), the ANC earphone can be used as a standard earphone; 3. When an electronic equipment described by the present invention is connected to a standard earphone (not the present invention), the electronic equipment can be used as a typical electronic equipment.

The present invention integrates the noise canceling circuit, the detection and control module A, the switch module A and the electrical energy storage module through integrated circuit technology onto a single chip, which is installed inside audio playback unit, control unit or the base of earphone plug, further simplifying the structure of ANC earphones.

28—electrical energy storage module; 29—plug body; 30—plug base; 31—control unit; and 32—control device.

DETAILED DESCRIPTION OF THE INVENTION

The invention will be further described with the following embodiments and drawings.

Figure 1:
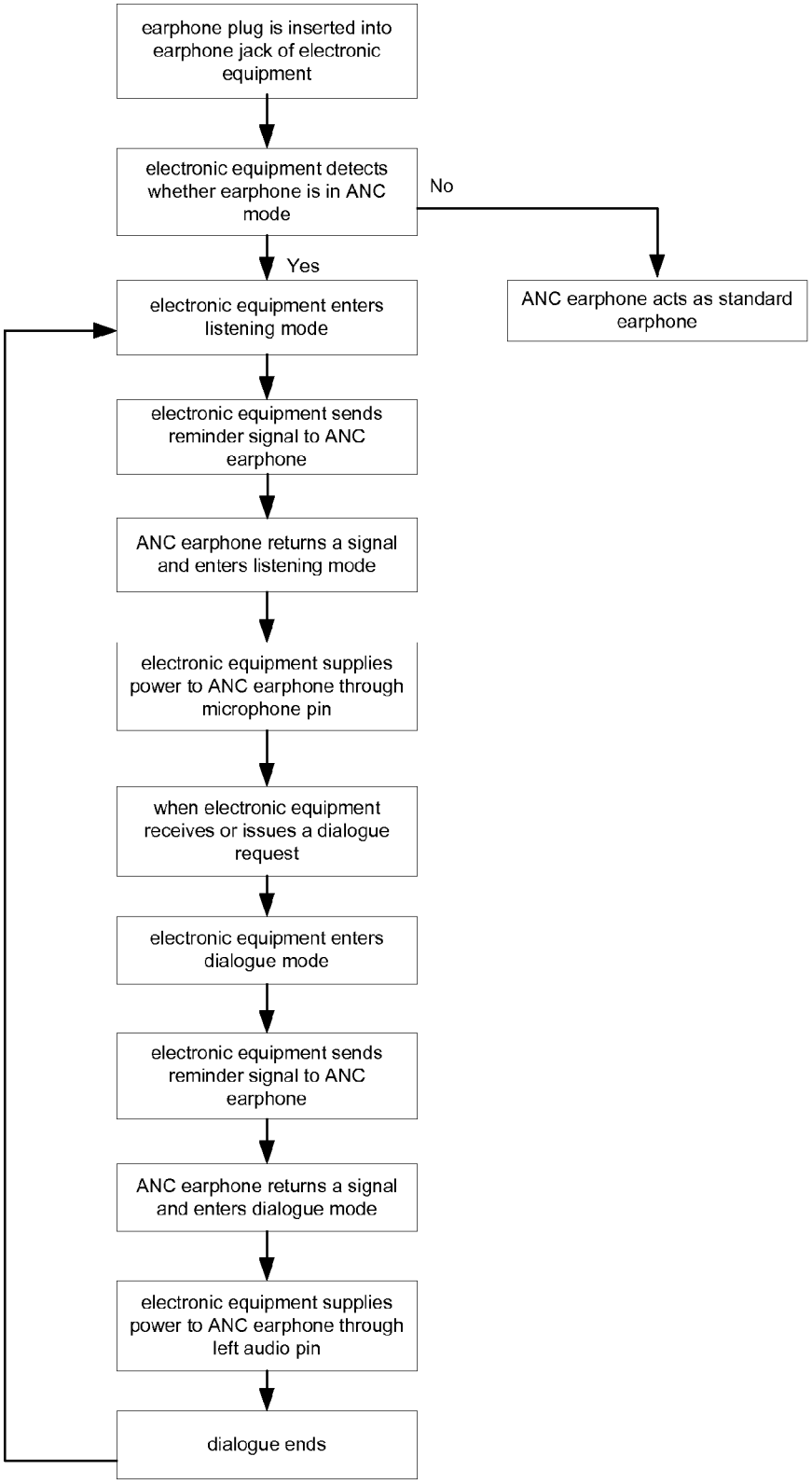
FIG. 1 is a flow chart of supplying power from an electronic equipment to an ANC earphone described in a first embodiment of this invention.

The first embodiment of the present invention: a method for supplying power for an ANC earphone by utilization of a power source of electronic equipment. Its operation flow chart is shown in FIG. 1. When the earphone plug is inserted into an earphone jack of the electronic equipment, the electronic equipment and the ANC earphone enter into detection mode, i.e., the electronic equipment detects whether the described earphone is in ANC mode. A detection and control module of the electronic equipment tests the characteristics of the earphone plug to determine whether it is an ANC earphone or a standard earphone. The following detection method can be used:

Detect the electrical characteristics (e.g., resistance, capacitance, inductance, or signal) of the microphone contact (or terminal or a pin), left channel (or left side) audio contact, or right channel (or right side) audio contact of the earphone plug; if the electrical characteristics detected based on this electrical test match predetermined electrical parameters for ANC earphones, the earphone is in ANC mode; if the electrical characteristics detected based on this electrical test match the predetermined electrical parameters for standard (or normal, regular, or ordinary) earphones, the earphone is in a normal (or standard, regular, or ordinary) mode, i.e., non-ANC mode.

When the ANC earphone is in a normal mode (non-ANC mode), it operates as a standard earphone to connect (or couple) and interact with the electronic equipment. The standard earphone does not require the electronic equipment to supply power.

When the ANC earphone is in ANC mode, it uses the power source of the electronic equipment to supply power to its noise canceling circuit. The electronic equipment and the ANC earphone enter into listening mode.

In listening mode, a switch module of the electronic equipment disconnects (or decouples) a microphone terminal of an audio module from a microphone contact of the earphone jack, and connects a power source of the electronic equipment to the microphone contact of the earphone jack; a switch module of the ANC earphone disconnects a microphone contact of the earphone plug from a hands-free microphone circuit of the earphone, connects the microphone contact to a power supply terminal of the noise canceling circuit, a left channel audio contact to a left channel audio terminal of the noise canceling circuit, and a right channel audio contact to a right channel audio terminal of the noise canceling circuit. In this mode, the hands-free microphone does not function; the microphone channel is occupied and used as the power output channel of the electronic equipment.

When the electronic equipment receives or issues a dialogue request, it enters into a dialogue mode and sends a reminder signal to the ANC earphone; the ANC earphone returns a signal to the electronic equipment and switches to dialogue mode.

In dialogue mode, the switch module of the electronic equipment disconnects the power source from the microphone contact of the earphone jack, disconnects a left channel audio terminal of the audio module from the left channel audio contact of the earphone jack, connects the power source to the left channel audio contact of the earphone jack, connects the right channel audio terminal of the audio module to the right channel audio contact of the earphone jack, and connects the microphone terminal of the audio module to the microphone contact of the earphone jack; the switch module of the ANC earphone connects the left channel audio contact of the earphone plug to the power supply terminal of the noise canceling circuit, connects the right channel audio contact of the earphone plug to the right and left channel audio terminals of the noise canceling circuit, and connects the microphone contact of the earphone plug to the hands-free microphone circuit of the earphone.

In dialogue mode, the hands-free microphone circuit is properly connected and functioning. The left audio channel is occupied to operate as a power output channel of the electronic equipment. The audio signal of the left audio channel of the electronic equipment is not sent to the earphone. The audio signal of the right audio channel of the electronic equipment is transmitted to the right channel audio terminal and the left channel audio terminal of the noise canceling circuit of the earphone through the right audio channel. The user hears the signal of the right audio channel from both the left and right speakers.

When the dialogue ends, the electronic equipment enters listening mode, and sends a reminder signal to the ANC earphone. The ANC earphone returns a signal to the electronic equipment, and switches to listening mode.

When the ANC earphone switches between the listening and dialogue modes, i.e., the power supply terminal of the noise canceling circuit switches between the microphone contact and the left channel audio contact, the ANC earphone has no external power supply for a moment. An electrical energy storage module of the ANC earphone obtains power from the electronic equipment to charge up and store during ANC usage (i.e., listening and dialogue modes), and continues to supply power to the noise canceling circuit, the detection and control module, and the switch module when there is no external power supply.

A device used to achieve the method of the invention discussed above includes the ANC earphone 1 and electronic equipment 2. The components of the ANC earphone with identical names as the components of the electronic equipment are referred to by an "A" identifier and the components of the electronic equipment with identical names as the components of the ANC earphone are referred to by a "B" identifier. The electronic equipment 2 has speech capabilities and is a cell phone, a personal computer, a laptop, or a tablet.

The ANC earphone 1 includes an earphone plug 3, an audio playback unit 4, a noise canceling circuit 5, a hands-free microphone circuit 6, a detection and control module A 24, a switch module A 25, and an electrical energy storage module 28. The electrical energy storage module 28, power supply terminal 11 of the noise canceling circuit, and detection and control module A 24 are connected to the switch module A 25. The audio playback unit 4, noise canceling circuit 5, and hands-free microphone circuit 6 are connected to the switch module A 25. The earphone plug 3 includes a ground contact A 7, a microphone contact A 8, a left channel audio contact A 9, and a right channel audio contact A 10. The noise canceling circuit 5 includes a power supply terminal 11, a left channel audio terminal A 12, and a right channel audio terminal A 13. The detection and control module A 24 is connected to the microphone contact A 8, left channel audio contact A 9, or right channel audio contact A 10.

The electronic equipment 2 includes an audio module 14, a power source 15, an earphone jack 16, a detection and control module B 26, and a switch module B 27. The power source 15 is connected to the switch module B 27. The earphone jack 16 includes a ground contact B 17, a microphone contact B 18, a left channel audio contact B 19, and a right channel audio contact B 20. The audio module 14 includes a microphone terminal 21, a left channel audio terminal B 22, and a right channel audio terminal B 23. The detection and control module B 26 is connected to the microphone contact B 18, left channel audio contact B 19, or right channel audio contact B 20.

Figure 11:
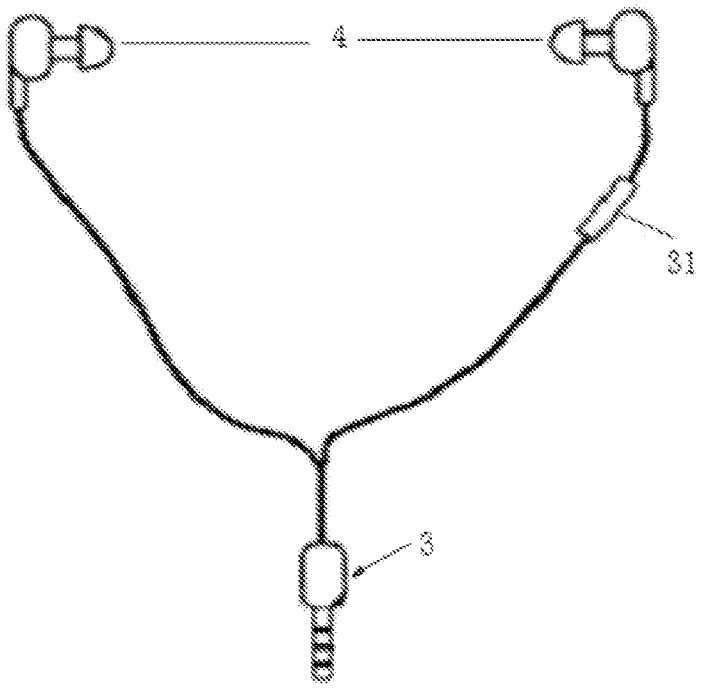
FIG. 11 is a diagram of an ANC earphone.

As shown in FIG. 11, the ANC earphone 1 also includes a control unit 31 connected between the earphone plug 3 and the audio playback unit 4. The control unit 31 is used for controlling on or off state, volume, and quality of the audio playback unit 4.

The noise canceling circuit 5, the detection and control module A 24, the switch module A 25, and the electrical energy storage module 28 can be integrated on a single chip. The single chip is installed in the control unit 31.

The detection and control module B 26 and the switch module B 27 can also be integrated on a single chip. The single chip is installed in the electronic equipment 2.

The electronic equipment 2 also includes a control device 32. The control device 32 is used for turning on or off the power source 15 and controlling the detection and control module B 26 and the switch module B 27. The control device 32 is a hardware, software, or firmware module. The control device 32 is also used to set and adjust the operating parameters of the ANC earphone 1.

Figure 2:
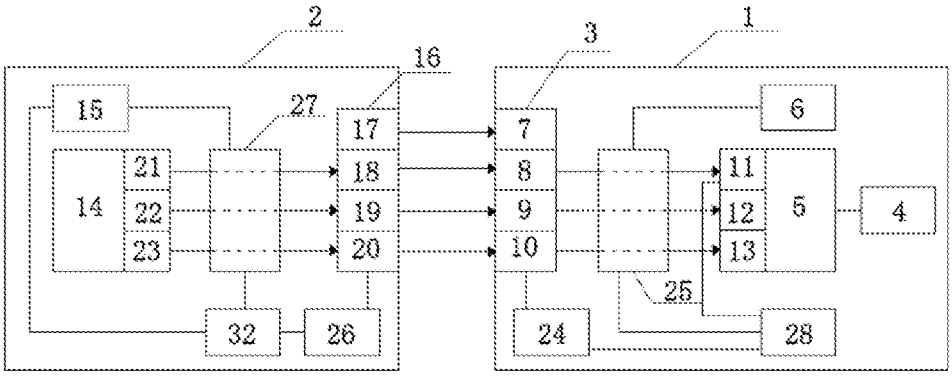
FIG. 2 is a diagram of the connection between the ANC earphone and the electronic equipment in detection mode described in the first embodiment of this invention.
Figure 6:
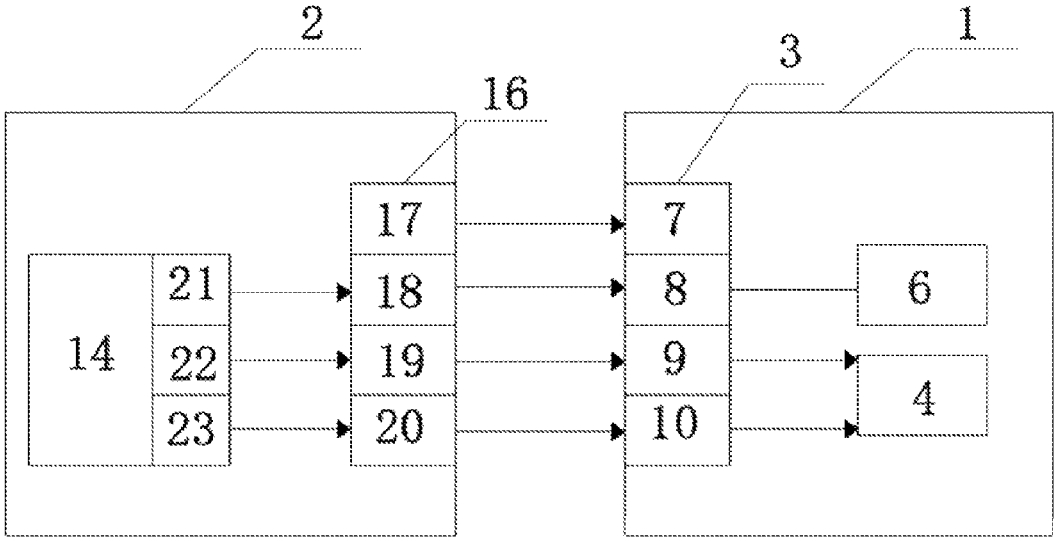
FIG. 6 is a diagram of the connection between the ANC earphone and the electronic equipment in the normal mode (non-ANC mode) described in the first embodiment of this invention (only earphone plug, earphone jack, audio playback unit, hands-free microphone circuit, and audio module are shown)

How the system works: when the earphone plug 3 is inserted into the earphone jack 16 of the electronic equipment 2, both the electronic equipment and the ANC earphone enter a detection mode. A connection diagram of detection mode is shown in FIG. 2. When the electrical equipment is in the detection mode, the microphone contact B 18 connects through the switch module B 27 to the microphone terminal 21, the left channel audio contact B 19 is connected through the switch module B 27 to the left channel audio terminal B 22, and the right channel audio contact B 20 is connected through the switch module B 27 to the right channel audio terminal B 23. When the ANC earphone is in the detection mode, the power supply terminal 11 is connected through the switch module A 25 to the microphone contact A 8, the left channel audio terminal A 12 is connected through the switch module A 25 to the left channel audio contact A 9, and the right channel audio terminal A 13 is connected through the switch module A 25 to the right channel audio contact A 10. While the system is in the detection mode, the detection and control module B 26 detects the electrical characteristics (e.g., resistance, capacitance, inductance, or signal) of the microphone contact A 8 through the microphone contact B 18, detects the electrical characteristics of the left channel audio contact A 9 through the left channel audio contact B 19, and detects the electrical characteristics of the right channel audio contact A 10 through the right channel audio contact B 20. These electrical characteristics are used to judge whether the ANC earphone 1 is operating in the ANC mode. If the earphone is operating in the normal mode (non-ANC mode), the connection diagram is shown in FIG. 6.

Figure 3:
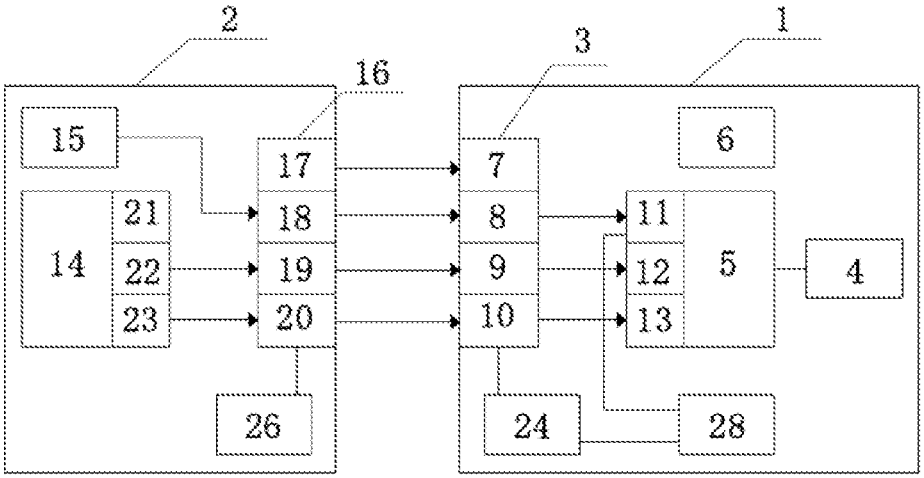
FIG. 3 is a diagram of the connection between the ANC earphone and the electronic equipment in listening mode described in the first embodiment of this invention (switch module A, switch module B, and control device are omitted)

If the earphone is operating in the ANC mode, the default mode of electronic equipment 2 is listening mode. The connection diagram of listening mode is shown in FIG. 3. The detection and control module B 26 sends a reminder signal to the detection and control module A 24. The detection and control module A 24 returns a signal to the detection and control module B 26. The ANC earphone 1 also enters listening mode. The switch module B 27 (not shown in the figure) disconnects the microphone terminal 21 from the microphone contact B 18, and connects the power source 15 to the microphone contact B 18; thus achieving the objective of supplying power to the noise canceling circuit 5 and storing energy into the electrical energy storage module 28.

Figure 4:
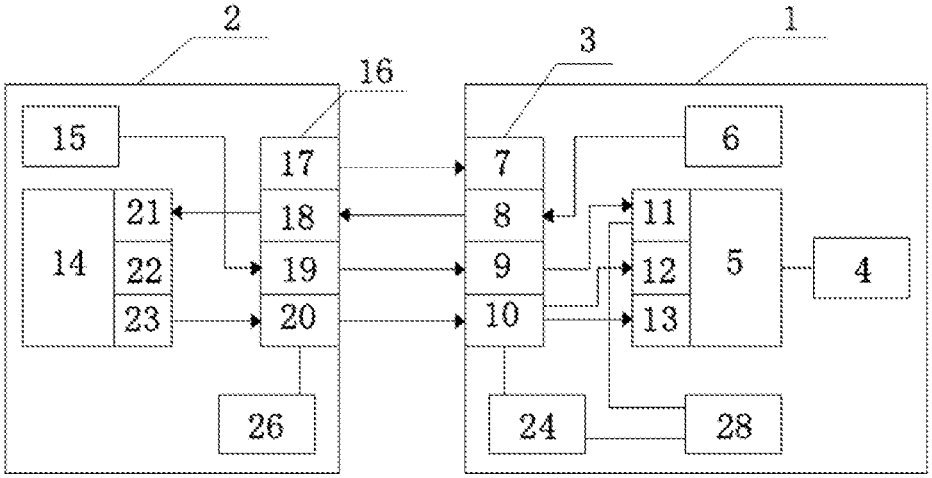
FIG. 4 is a diagram of the connection between the ANC earphone and the electronic equipment in dialogue mode described in the first embodiment of this invention (switch module A, switch module B, and control device are omitted)

The connection diagram of dialogue mode is shown in FIG. 4. When the electronic equipment 2 receives or issues a dialogue request, the electronic equipment 2 enters dialogue mode. The switch module B 27 (not shown in the figure) disconnects the power source 15 from the microphone contact B 18, disconnects the left channel audio terminal B 22 of the audio module 14 of the electronic equipment 2 from the left channel audio contact B 19 of the earphone jack 16, connects the power source 15 to the left channel audio contact B 19, connects the right channel audio terminal B 23 of the audio module 14 to the right channel audio contact B 20 of the earphone jack 16, and connects the microphone terminal 21 of the audio module 14 to the microphone contact B 18 of the earphone jack 16. The detection and control module B 26 sends a reminder signal to the detection and control module A 24. The detection and control module A 24 returns a signal to the detection and control module B 26. The ANC earphone 1 also enters dialogue mode. The switch module A 25 (not shown in figure) connects the left channel audio contact A 9 of the earphone plug 3 to the power supply terminal 11 of the noise canceling circuit 5, connects the right channel audio contact A 10 of the earphone plug 3 to the left channel audio terminal A 12 and right channel audio terminal A 13 of the noise canceling circuit 5, and connects the microphone contact A 8 of the earphone plug 3 to the hands-free microphone circuit 6.

Further, during mode switching, the electrical energy storage module 28 supplies the stored energy to the noise canceling circuit 5, detection and control module A 24, and switch module A 25.

At the end of dialogue, the ANC earphone 1 and the electronic equipment 2 both switch to listening mode.

Figure 5:
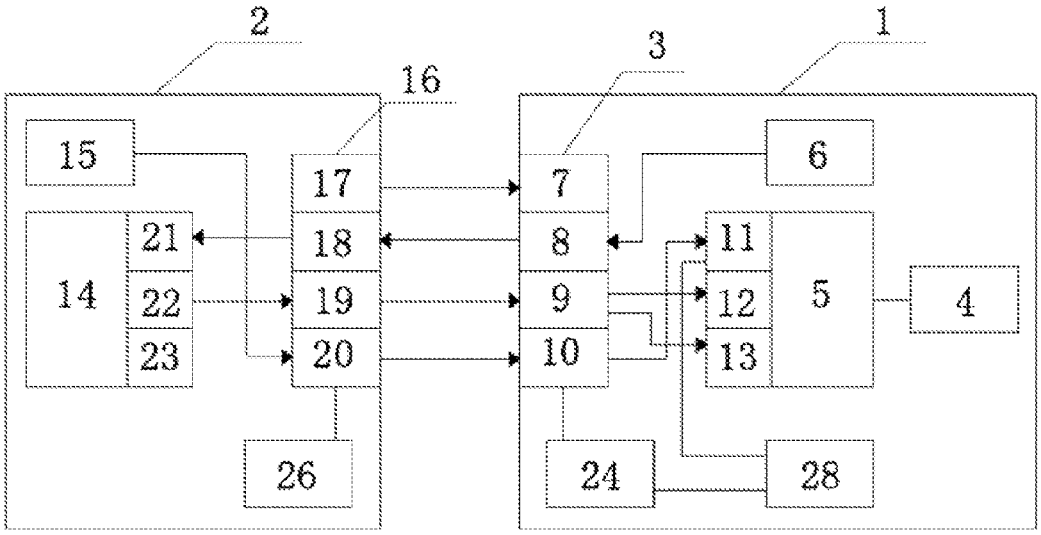
FIG. 5 is a diagram of the connection between an ANC earphone and an electronic equipment in dialogue mode described in a second embodiment of this invention (switch module A, switch module B, and control device are omitted)
Figure 7:
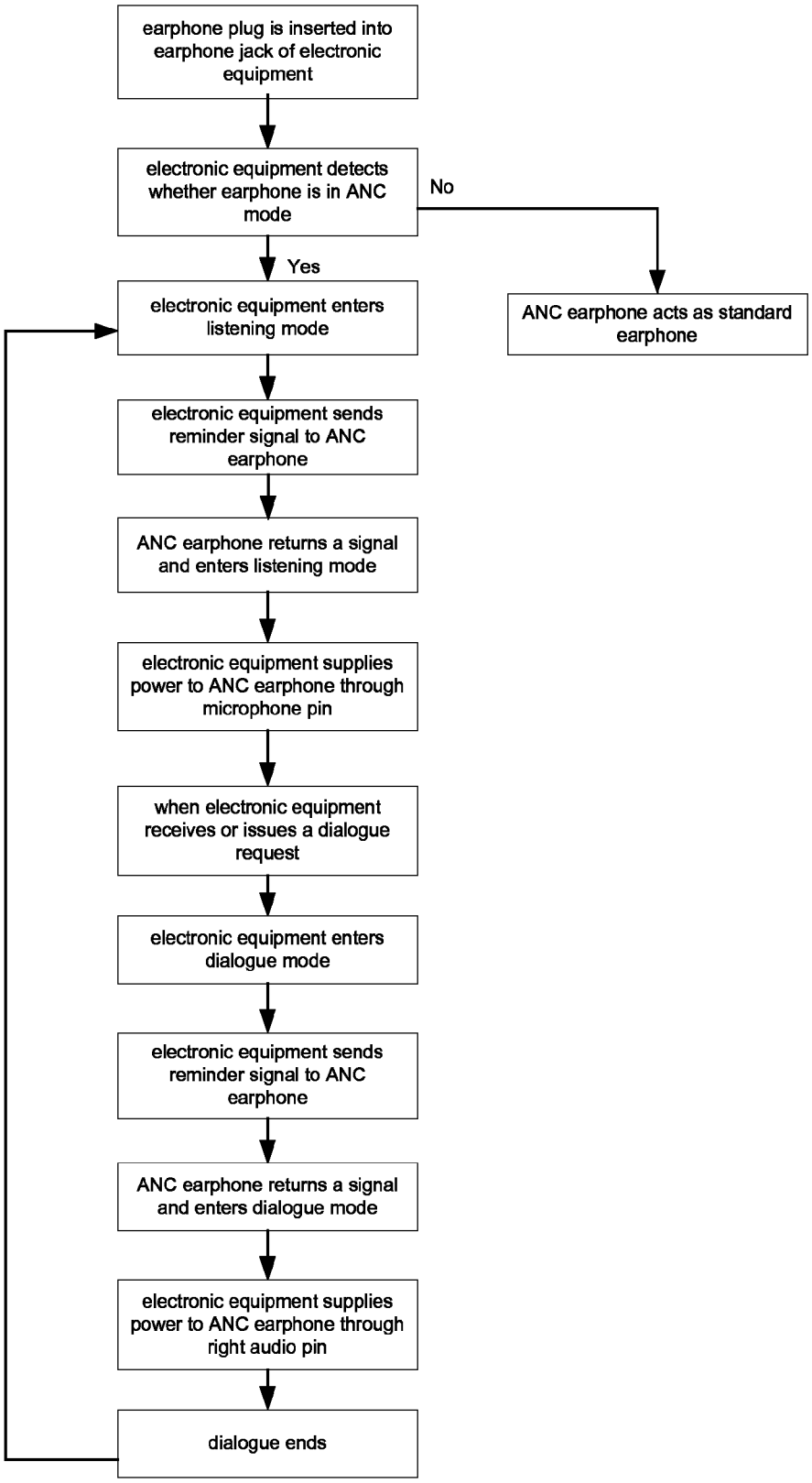
FIG. 7 is a flow chart of supplying power from the electronic equipment to the ANC earphone described in the second embodiment of this invention.

In a second embodiment of the present invention: the following are differences compared to the first embodiment. In dialogue mode, the right channel audio contact B 20 of the earphone jack 16 of electronic equipment 2 is used to supply power to the ANC earphone 1. As shown in FIGS. 5 and 7, when the electronic equipment 2 receives or issues a dialogue request, the electronic equipment 2 enters dialogue mode. The switch module B 27 (not shown in the figure) disconnects the power source 15 from the microphone contact B 18, disconnects the right channel audio terminal B 23 of the audio module 14 from the right channel audio contact B 20 of the earphone jack 16, connects the power source 15 to the right channel audio contact B 20, connects the left channel audio terminal B 22 of the audio module 14 to the left channel audio contact B 19 of the earphone jack 16, and connects the microphone terminal 21 of the audio module 14 to the microphone contact B 18 of the earphone jack 16. The detection and control module B 26 sends a reminder signal to the detection and control module A 24. The detection and control module A 24 returns a signal to the detection and control module B 26. The ANC earphone 1 also enters dialogue mode. The switch module A 25 (not shown in the figure) connects the right channel audio contact A 10 of the earphone plug 3 to the power supply terminal 11 of the noise canceling circuit 5, connects the left channel audio contact A 9 of the earphone plug 3 to the left channel audio terminal A 12 and the right channel audio terminal A 13 of the noise canceling circuit 5, and connects the microphone contact A 8 of the earphone plug 3 to the hands-free microphone circuit 6.

Figure 8:
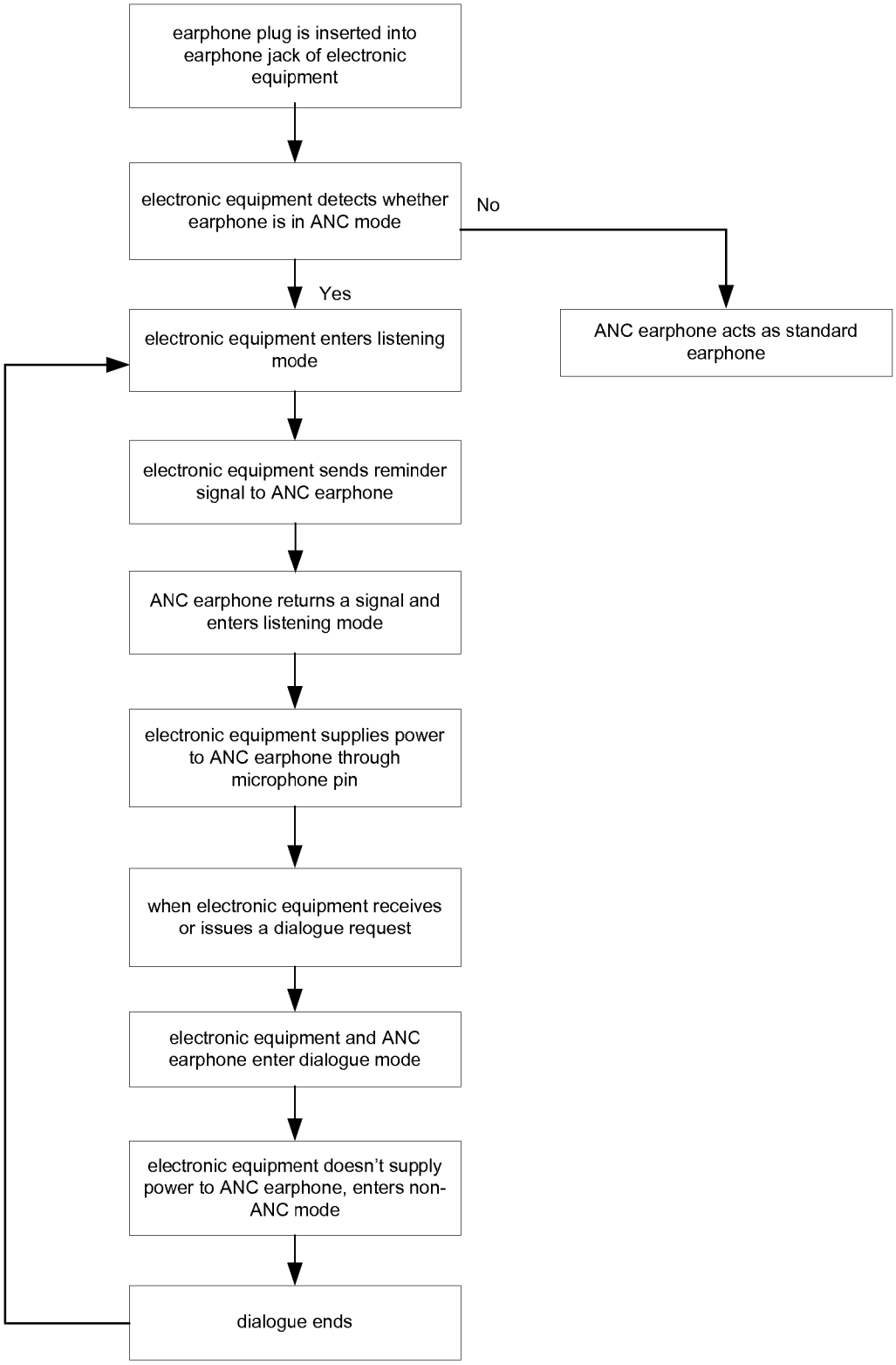
FIG. 8 is a flow chart of supplying power from an electronic equipment to an ANC earphone described in a third embodiment of this invention.

In a third embodiment of the present invention: the following are differences compared to the first embodiment. In listening mode, the electronic equipment 2 supplies power to the noise canceling circuit 5, detection and control module A 24, switch module A 25, and electrical energy storage module 28 of the ANC earphone 1; the power supply method and device in listening mode are the same as in the first embodiment. But, in dialogue mode the electronic equipment 2 does not supply power to the ANC earphone 1, and the ANC earphone 1 operates as a standard earphone and does not have ANC function. The electronic equipment and ANC earphone's operation flow chart is shown in FIG. 8.

When the electronic equipment 2 receives or issues a dialogue request, the electronic equipment 2 enters dialogue mode and sends a reminder signal to the ANC earphone 1. The ANC earphone 1 returns a signal to the electronic equipment 2 and switches to dialogue mode.

Figure 9:
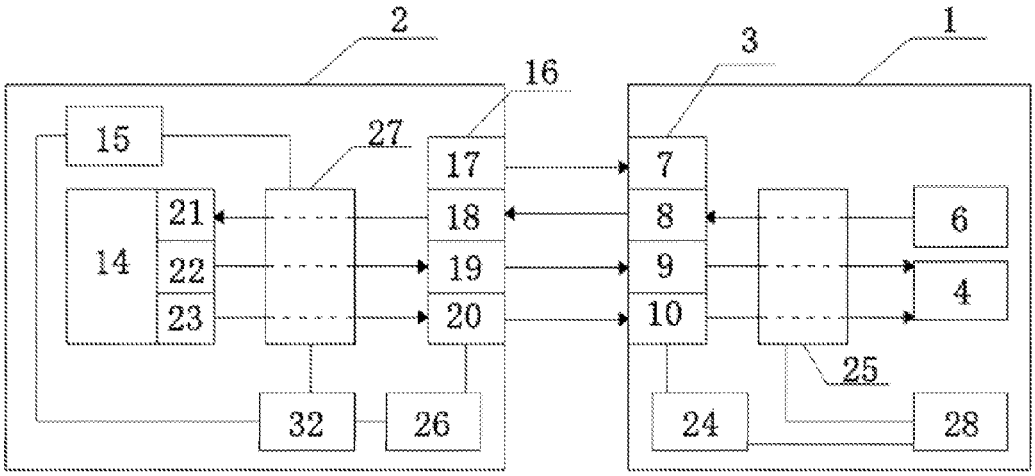
FIG. 9 is a diagram of the connection between the ANC earphone and the electronic equipment in dialogue mode described in the third embodiment of this invention.

As shown in FIG. 9, in dialogue mode, the switch module B 27 of the electronic equipment 2 disconnects the power source 15 of the electronic equipment 2 from the microphone contact B 18 of the earphone jack 16, connects the microphone terminal 21 of the audio module 14 of the electronic equipment 2 to the microphone contact B 18 of the earphone jack 16, connects the left channel audio terminal B 22 to the left channel audio contact B 19, and connects the right channel audio terminal B 23 to the right channel audio contact B 20; the switch module A 25 of the ANC earphone 1 disconnects the power supply terminal 11 of the noise canceling circuit 5 from the microphone contact A 8 of the earphone plug 3, connects the left channel audio contact A 9 of the earphone plug 3 to the left channel audio terminal of the audio playback unit 4, connects the right channel audio contact A 10 to the right channel audio terminal of the audio playback unit 4, and connects the microphone contact A 8 of the earphone plug 3 to the hands-free microphone circuit 6.

When the ANC earphone 1 is in dialogue mode, the electronic equipment 2 does not supply power to the ANC earphone 1. The ANC earphone 1, without external power source, relies on the electrical energy storage module 28 to continue supplying power to the detection and control module A 24 and switch module A 25. The electrical energy storage module 28 of the ANC earphone 1 gets power from the electronic equipment 2 for charging in listening mode.

When the dialogue ends, the electronic equipment 2 enters listening mode, and sends a reminder signal to the ANC earphone 1. The ANC earphone 1 returns a signal to the electronic equipment 2, and switches to listening mode.

Figure 12:
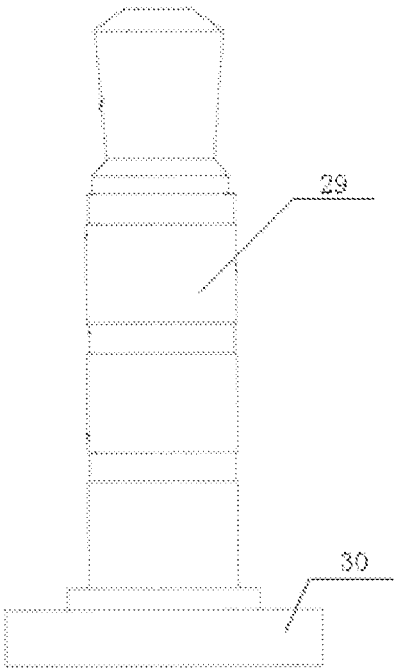
FIG. 12 is a diagram of an earphone plug of the ANC earphone.

In a fourth embodiment of the present invention: the following are differences compared to the first embodiment. As shown in FIG. 12, the earphone plug 3 includes a plug body 29 and a plug base 30 which is connected to the plug body 29. At least one of the noise canceling circuit 5, detection and control module A 24, switch module A 25, or electrical energy storage module 28 is installed in the plug base 30.

In a fifth embodiment of the present invention: the following are differences compared to the second embodiment. At least one of the noise canceling circuit 5, detection and control module A 24, switch module A 25, or electrical energy storage module 28 is installed in the audio playback unit 4.

In a sixth embodiment of the present invention: the following are differences compared to the second embodiment. At least one of the noise canceling circuit 5, detection and control module A 24, switch module A 25, or electrical energy storage module 28 is connected between the earphone plug 3 and the control unit 31, or between the control unit 31 and the audio playback unit 4.

In a seventh embodiment of the present invention: the following are differences compared to the first embodiment. At least one of the noise canceling circuit 5, detection and control module A 24, switch module A 25, or electrical energy storage module 28 is installed in the control unit 31.

In an eighth embodiment of the present invention: the following are differences compared to the first embodiment. The invention uses manual select method to replace automatic detection method. The detection and control module A 24 of the ANC earphone 1 and the detection and control module B 26 of the electronic equipment 2 both use manual switches. The ANC earphone 1 does not need an electrical energy storage module 28. The detection and control module A 24 and the switch module A 25 are manual hardware switches which are used to turn on or off the listening and dialogue modes of the ANC earphone 1. The detection and control module B 26 and the switch module B 27 are manual hardware switches or man machine interface which is used to turn on or off the listening, dialogue, and ANC modes of the electronic equipment 2.

Figure 13:
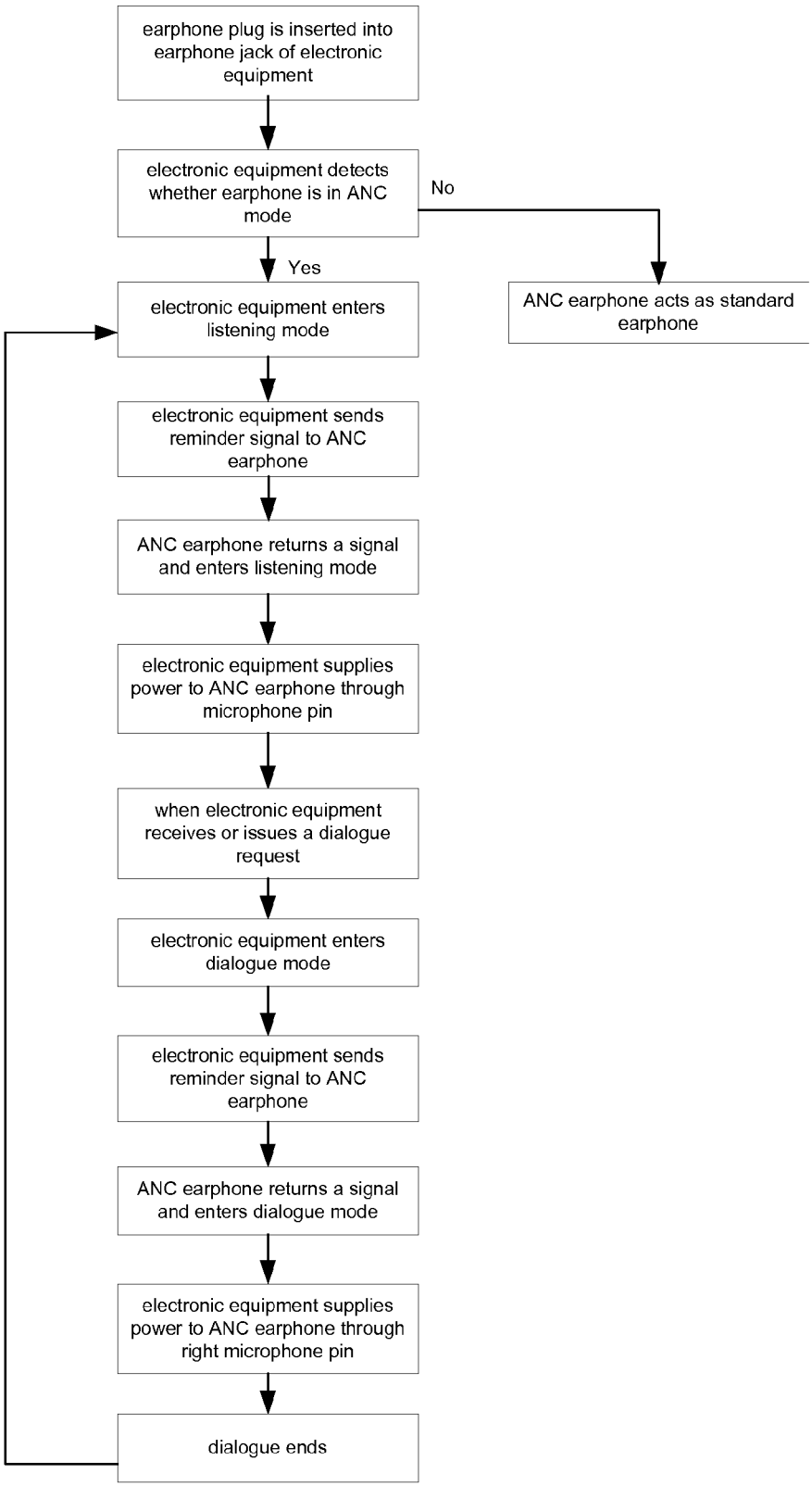
FIG. 13 is a flow chart of supplying power from an electronic equipment to an ANC earphone described in ninth and tenth embodiments of this invention.

In a ninth embodiment of the present invention: as shown in FIG. 13, the detection method in detection mode and the power supply method in listening mode are the same as in the first embodiment. In dialogue mode, the switch module B 27 of the electronic equipment 2 connects the power source 15 of the electronic equipment 2 to the microphone contact B 18 of the earphone jack 16, and connects the microphone terminal 21 of the audio module 14 of the electronic equipment 2 to the left channel audio contact B 19 of the earphone jack 16; the switch module A 25 of the ANC earphone 1 connects the microphone contact A 8 of the earphone plug 3 to the power supply terminal 11 of the noise canceling circuit 5, connects the left channel audio contact A 9 of the earphone plug 3 to the hands-free microphone circuit 6 of the ANC earphone 1, and connects the right channel audio contact A 10 of the earphone plug 3 to the left channel audio terminal A 12 and right channel audio terminal A 13 of the noise canceling circuit 5; either the left channel audio terminal B 22 or right channel audio terminal B 23 of the audio module 14 is selected and connected to the right channel audio contact B 20 of the earphone jack 16, the selected channel audio terminal is used to transmit the left or right audio signal sent from the audio module 14.

In dialogue mode, the invention continues to use the route in listening mode to supply power through the microphone contacts. The invention continues to occupy the microphone channel as the power output channel of the electronic equipment 2. The invention selects the left audio channel to transmit hands-free microphone signals to make the hands-free microphone circuit 6 connect and operate normally. If the left channel audio terminal B 22 of the audio module 14 is connected to the right channel audio contact B 20 of the earphone jack 16, the left audio signal is transmitted through the right audio channel to the left channel audio terminal A 12 and right channel audio terminal A 13 of the noise canceling circuit 5. The sound outputs from both the left and right speakers are the left audio signal. If the right channel audio terminal B 23 of the audio module 14 is connected to the right channel audio contact B 20 of the earphone jack 16, the right audio signal is transmitted through the right audio channel to the left channel audio terminal A 12 and right channel audio terminal A 13 of the noise canceling circuit 5. The sound outputs from both the left and right speakers are the right audio signal.

When the dialogue ends, the electronic equipment 2 enters listening mode and sends a reminder signal to the ANC earphone 1. The ANC earphone 1 returns a signal to the electronic equipment 2 and switches to listening mode.

Since the power supply routes of listening mode and dialogue mode are the same, the ANC earphone 1 does not have its power cutoff during mode switching. Hence, the ANC earphone 1 does not need to store energy in real time.

In detection mode and listening mode, the device and method to achieve this embodiment is similar to the first embodiment, but does not need the electrical energy storage module 28.

Figure 14:
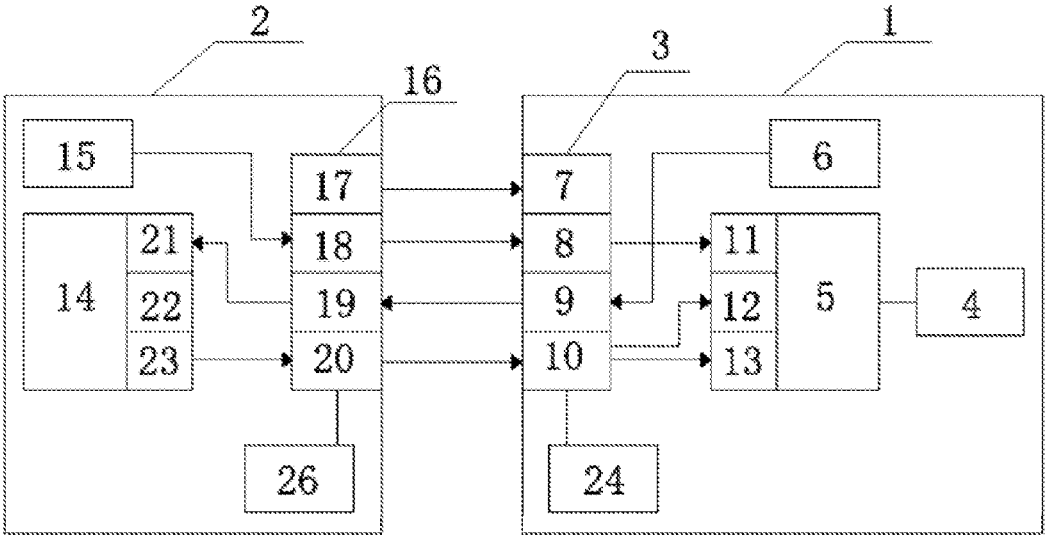
FIG. 14 is a diagram of the connection between the ANC earphone and the electronic equipment in dialogue mode described in the ninth embodiment of this invention (switch module A, switch module B, and control device are omitted)

The connection diagram of dialogue mode is shown in FIG. 14. The power supply module 15 is connected through the switch module B 27 (not shown in the figure) to the microphone contact B 18. The microphone terminal 21 is connected through the switch module B 27 to the left channel audio contact B 19. The right channel audio terminal B 23 is connected through the switch module B 27 to the right channel audio contact B 20 (the switch module B 27 can also connect the left channel audio terminal B 22 to the right channel audio contact B 20). The microphone contact A 8 is connected through the switch module A 25 (not shown in the figure) to the power supply terminal 11. The left channel audio contact A 9 is connected through the switch module A 25 to the hands-free microphone circuit 6. The right channel audio contact A 10 is connected through the switch module A 25 to the left channel audio terminal A 12 and the right channel audio terminal A 13.

Where the noise canceling circuit 5, detection and control module A 24, and switch module A 25 are installed may follow any one of the embodiments 4 to 7.

Figure 15:
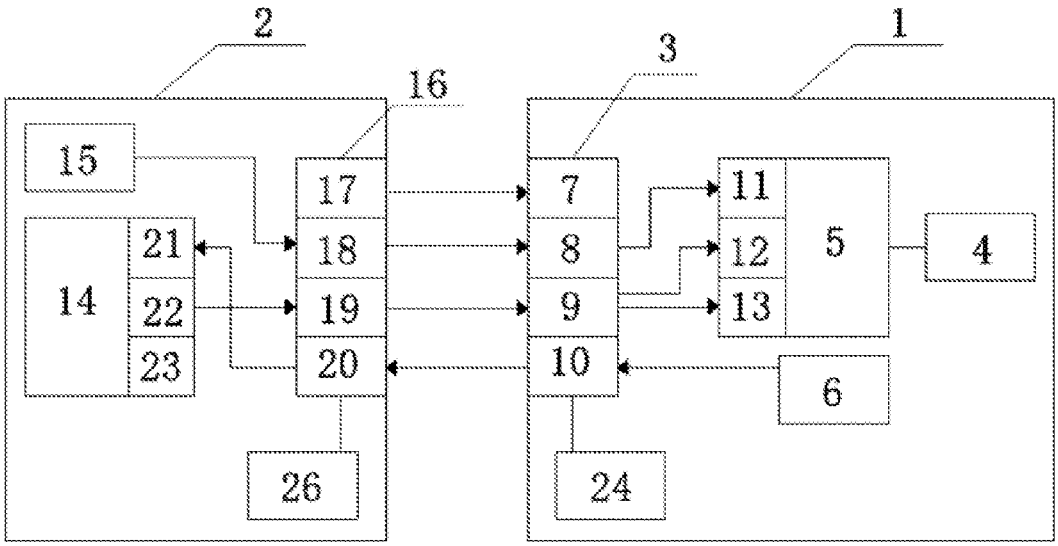
FIG. 15 is a diagram of the connection between the ANC earphone and the electronic equipment in dialogue mode described in the tenth embodiment of this invention (switch module A, switch module B, and control device are omitted), where the components in the devices are: 1—ANC earphone; 2—electronic equipment; 3—earphone plug; 4—audio playback unit; 5—noise canceling circuit; 6—hands-free microphone circuit; 7—ground contact A; 8—microphone contact A; 9—left channel audio contact A; 10—right channel audio contact A; 11—power supply terminal; 12—left channel audio terminal A 13—right channel audio terminal A; 14—audio module; 15—power source; 16—earphone jack; 17—ground contact B; 18—microphone contact B; 19—left channel audio contact B; 20—right channel audio contact B; 21—microphone terminal; 22—left channel audio terminal B; 23—right channel audio terminal B; 24—detection and control module A; 25—switch module A; 26—detection and control module B; 27—switch module B.

In a tenth embodiment of the present invention, as compared with the ninth embodiment, a difference is: in dialogue mode, the right audio channel is used instead of the left audio channel to transmit the microphone signal. The connection diagram is shown in FIG. 15.

In the above ten embodiments, the ANC earphone 1 further includes a manual switch or an electric switch to turn on or off the ANC mode of the ANC earphone 1. The manual switch or the electric switch is installed in the control unit 31. The detection and control modules and the switch modules of the electronic equipment 2 and the ANC earphone 1 can be realized by electronic circuit technology.

In the above ten embodiments, the following ways can be used by the electronic equipment 2 to detect whether the ANC earphone 1 is in ANC mode. The detection and control module B 26 sends an inquiry signal to the detection and control module A 24. The detection and control module A 24 returns the mode (ANC mode or non-ANC mode) of the ANC earphone 1 as a signal to the detection and control module B 26. This detecting of the earphone is done by signal handshaking exchange. In detection mode, the microphone terminal 21 of the audio module 14 provides a bias voltage to the microphone contact A 8 of the earphone plug 3 through the microphone contact B 18 of the earphone jack 16. The detection and control module A 24, which is connected to the microphone contact A 8, also gets the power source to complete the signal handshaking exchange with the detection and control module B 26.

Figure 10:
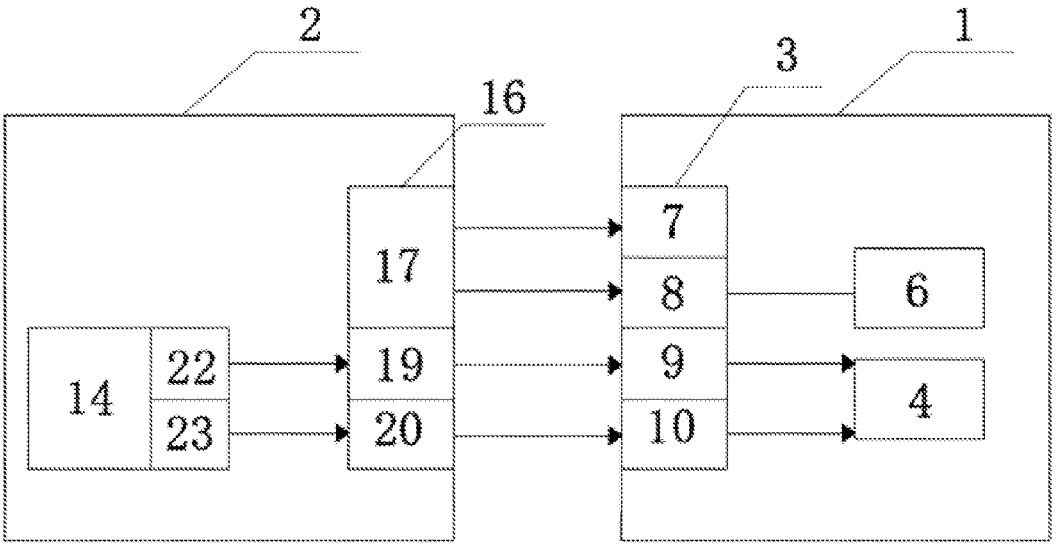
FIG. 10 is a diagram of the connection between the ANC earphone described in this invention and typical audio equipment (only earphone plug, earphone jack, audio playback unit, hands-free microphone circuit, and audio module are shown)

Additionally, when the electronic equipment 2 is a typical audio device, such as a music player, video player, multimedia player, and portable game console, its earphone jack does not have a microphone contact. It cannot supply power to ANC earphone 1. The connection diagram of ANC earphone 1 and electronic equipment 2 is shown in FIG. 10. However, the 4-pole (or 4-terminal) earphone plug of ANC earphone 1 described in the present invention is compatible with a 3-pole (or 3-terminal) earphone jack of a typical audio device, and can perform the listening function of a standard earphone.

The invention claimed is:

1. An electronic equipment device a power source;

a switch module, wherein the power source is coupled to the switch module of the electronic equipment;

an earphone jack comprising a ground contact, a microphone contact, a first channel audio contact, and a second channel audio contact, wherein the switch module of the electronic equipment is coupled to the microphone contact, first channel audio contact, and second channel audio contact of the earphone jack;

an audio module comprising a microphone terminal, a first channel audio terminal, and a second channel audio terminal, wherein the microphone, first channel, and second channel audio terminals of the audio module are coupled to the switch module of the electronic equipment;

a detection and control module is coupled to the earphone jack, wherein the switch module of the electronic equipment operates such that in a first switch mode, the power source is coupled through the switch module of the electronic equipment to the microphone contact of the earphone jack, and the first channel audio terminal of the audio module is coupled through the switch module of the electronic equipment to the first channel audio contact of the earphone jack, and in a second switch mode, the power source is coupled through the switch module of the electronic equipment to the first channel audio contact of the earphone jack, and the microphone terminal of the audio module is coupled through the switch module of the electronic equipment to the microphone contact of the earphone jack; and wherein the electronic equipment can be coupled to an ANC earphone.

2. The device of claim 1, wherein in the first and second switch modes, the second channel audio terminal of the audio module is coupled through the switch module of the electronic equipment to the second channel audio contact of the earphone jack.

3. The device of claim 1, wherein in a third switch mode, the power source is coupled through the switch module of the electronic equipment to the microphone contact of the earphone jack, the microphone terminal of the audio module is coupled through the switch module of the electronic equipment to the first channel audio contact of the earphone jack, and the first channel audio terminal of the audio module is coupled through the switch module of the electronic equipment to the second channel audio contact of the earphone jack.

4. The device of claim 1, wherein the detection and control module of the electronic equipment and the switch module of the electronic equipment are integrated on a single chip.

5. The device of claim 1, wherein the detection and control module of the electrical equipment and the switch module of the electrical equipment use manual hardware switches or a man machine interface to turn on or off the first switch mode, the second switch mode, and an ANC mode of the electronic equipment.

6. An ANC earphone device comprising:

an earphone plug comprising a ground contact, a microphone contact, a first channel audio contact, and a second channel audio contact;

a switch module, wherein the switch module of the ANC earphone is coupled to the microphone contact, first channel audio contact, and second channel audio contact of the earphone plug;

a noise canceling circuit comprising a power supply terminal, a first channel audio terminal, and a second channel audio terminal, wherein the switch module of the ANC earphone is coupled to the power, first channel, and second channel audio terminals of the noise canceling circuit;

a detection and control module is coupled to the earphone plug;

an audio playback unit, wherein the audio playback unit is coupled to the noise canceling circuit;

a hands-free microphone circuit, wherein the hands-free microphone circuit is coupled to the switch module of the ANC earphone; and an electrical energy storage module, wherein the electrical energy storage module is coupled to the detection and control module, the switch module of the ANC earphone, and the power supply terminal of the noise canceling circuit, wherein the switch module of the ANC earphone operates such that in a first switch mode, the microphone contact of the earphone plug is coupled through the switch module of the ANC earphone to the power supply terminal of the noise canceling circuit, and the first channel audio contact of the earphone plug is coupled through the switch module of the ANC earphone to the first channel audio terminal of the noise canceling circuit, and in a second switch mode, the first channel audio contact of the earphone plug is coupled through the switch module of the ANC earphone to the power supply terminal of the noise canceling circuit, and the microphone contact of the earphone plug is coupled through the switch module of the ANC earphone to the hands-free microphone circuit.

7. The device of claim 6, wherein in the first switch mode, the second channel audio contact of the earphone plug is coupled through the switch module of the ANC earphone to the second channel audio terminal of the noise canceling circuit, and in the second switch mode, the second channel audio contact of the earphone plug is coupled through the switch module of the ANC earphone to the first channel and second channel audio terminals of the noise canceling circuit.

8. The device of claim 6, wherein in a third switch mode, the microphone contact of the earphone plug is coupled through the switch module of the ANC earphone to the power supply terminal of the noise canceling circuit, the first channel audio contact of the earphone plug is coupled through the switch module of the ANC earphone to the hands-free microphone circuit, and the second channel audio contact of the earphone plug is coupled through the switch module of the ANC earphone to the first channel and second channel audio terminals of the noise canceling circuit.

9. The device of claim 6, wherein the noise canceling circuit, the detection and control module of the ANC earphone, and the switch module of the ANC earphone are integrated on a single chip.

10. The device of claim 6, wherein the noise canceling circuit, the detection and control module of the ANC earphone, the switch module the ANC earphone, and the electrical energy storage module are integrated on a single chip.

11. The device of claim 6, wherein the ANC earphone further comprises a manual switch or an electrical switch to turn on or off an ANC mode of the ANC earphone.

12. The device of claim 6, wherein the detection and control module of the ANC earphone and the switch module of the ANC earphone use manual hardware switches to turn on or off the first switch mode and second switch mode of the ANC earphone.

* * * * *